US007984815B2

(12) United States Patent
Lynch

(10) Patent No.: US 7,984,815 B2
(45) Date of Patent: Jul. 26, 2011

(54) STORAGE SYSTEM

(76) Inventor: John P. Lynch, Burbank, SD (US)

( * ) Notice: Subject to any disclaimer, the term of this patent is extended or adjusted under 35 U.S.C. 154(b) by 520 days.

(21) Appl. No.: 12/077,280

(22) Filed: Mar. 17, 2008

(65) Prior Publication Data

US 2008/0237162 A1 Oct. 2, 2008

Related U.S. Application Data

(60) Provisional application No. 60/921,375, filed on Apr. 2, 2007.

(51) Int. Cl.
*A47B 43/00* (2006.01)

(52) U.S. Cl. ..... 211/186; 211/90.02; 312/108; 312/245

(58) Field of Classification Search ..... 211/186, 211/189, 90.01, 90.02, 90.04, 88.01; 312/245–247, 312/111, 108; 248/207
See application file for complete search history.

(56) References Cited

U.S. PATENT DOCUMENTS 2,226,112 A * 12/1940 Blechman ..... 312/31
3,085,839 A * 4/1963 Gallagher ..... 312/33
3,743,373 A * 7/1973 Camper et al. ..... 312/265.1
3,851,936 A * 12/1974 Muller ..... 312/108
4,043,625 A * 8/1977 Bleeker ..... 312/351
D246,147 S 10/1977 Müller
D247,403 S 3/1978 Müller
D249,215 S 9/1978 Offredi
D255,190 S 6/1980 Zapf
4,279,397 A * 7/1981 Larsson ..... 248/222.11
4,728,158 A * 3/1988 D'Elia et al. ..... 312/108
D297,087 S 8/1988 Fortescue
5,139,322 A * 8/1992 Aisley ..... 312/351
5,372,415 A * 12/1994 Tisbo et al. ..... 312/108
5,590,940 A * 1/1997 Richard ..... 312/287
D396,161 S 7/1998 Coglin
D440,078 S 4/2001 Carrabba
6,227,636 B1 * 5/2001 Lye et al. ..... 312/408
D449,181 S 10/2001 Story et al.
D456,178 S 4/2002 Couture et al.
6,471,311 B1 * 10/2002 Snyder ..... 312/247
7,441,846 B2 * 10/2008 Lupo ..... 312/205
2007/0159035 A1 * 7/2007 Mullen ..... 312/245

* cited by examiner

*Primary Examiner* — Korie Chan
(74) *Attorney, Agent, or Firm* — Merchant & Gould PC

(57) ABSTRACT

A storage unit for use in the home, garage, or business. The storage unit includes has a mounting arrangement that permits a user to easily mount the storage unit to a wall. The storage unit also includes a shelving arrangement that can be adapted to customize the use of the storage unit in the home, garage, or business.

27 Claims, 5 Drawing Sheets

STORAGE SYSTEM

CROSS-REFERENCE TO RELATED APPLICATIONS

This application claims the benefit of U.S. Provisional Application Ser. No. 60/921,375, filed Apr. 2, 2007; which application is incorporated herein by reference.

FIELD OF THE INVENTION

The present disclosure relates generally to storage arrangements, and various methods associated with such arrangements. More particularly, this disclosure relates to wall-mounting storage arrangements, and various methods associated with the manufacture and assembly of such arrangements.

BACKGROUND OF THE INVENTION

Conventional wall-mounting storage arrangements often have a particular mounting orientation and pre-defined storage compartments or areas. Improvement of such arrangements is desired, generally to provide better versatility with regards to mounting capabilities, and to provide storage areas that can be adapted to suit a user's particular needs.

SUMMARY OF THE INVENTION

One aspect of the present invention relates to a storage system that can be arranged in a variety of ways to allow a user to customize the storage space to the user's particular needs. Another aspect of the present invention relates to the versatility associated with an integral mounting arrangement that not only accommodates different mounting orientations, but also permits a user to mount the storage system to a variety of existing wall constructions.

Examples of desirable product features or methods are set forth in part in the description that follows, and in part will be apparent from the description, or may be learned by practicing various aspects of the disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

Reference will now be made in detail to exemplary aspects of the present disclosure that are illustrated in the accompanying drawings. Wherever possible, the same reference numbers will be used throughout the drawings to refer to the same or like parts.

Figure 1:
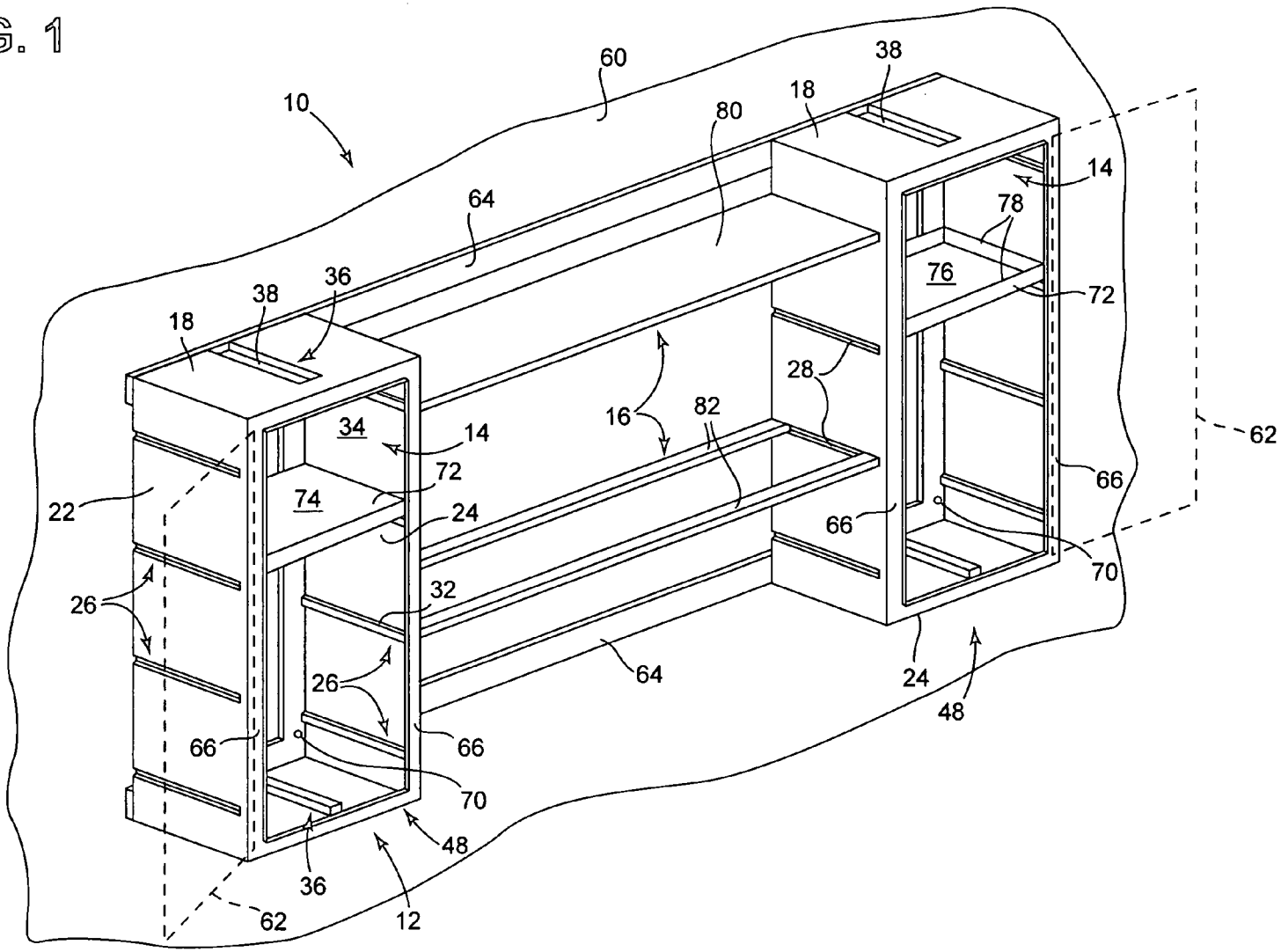
FIG. 1 is a front perspective view of one embodiment of a storage system, in accordance with the principles disclosed.

FIG. 1 illustrates one embodiment of a storage system 10 in accordance with the principles disclosed. The storage system 10 is modular and designed to provide a user with options in mounting and installation, and also in storage area configurations. That is, the modular components of the system can be mounted in a number of orientations; and are further configured to allow a user to customize or adapt the storage area to meet the user's particular storage needs. The storage system is further designed to mount to a variety of wall constructions.

The storage system 10 of FIG. 1 includes at least one main storage cabinet 12 (e.g., enclosure, storage unit, or locker). In the illustrated embodiment, the system 10 has two main cabinets 12, internal shelving 14, and external shelving 16. Internal shelving is intended to mean shelving that is located within the internal volume of a main cabinet, and external shelving is intended to mean shelving that is located outside a main cabinet. The two main cabinets 12 of the present system 10 are identical; the below description concerning the construction of the cabinets accordingly refers to only one of the main cabinets.

In the illustrated embodiment, the main cabinet 12 is constructed of molded polyethylene, but can be constructed of other materials. The cabinet has an overall width W1 (FIG. 2), length L1, and depth D1. The width W1 is about 2 feet; the length L1 is about 5 feet; and the depth D1 is about 16 inches. Other dimensional configuration can be provided in accordance with the principles disclosed.

Figure 3:
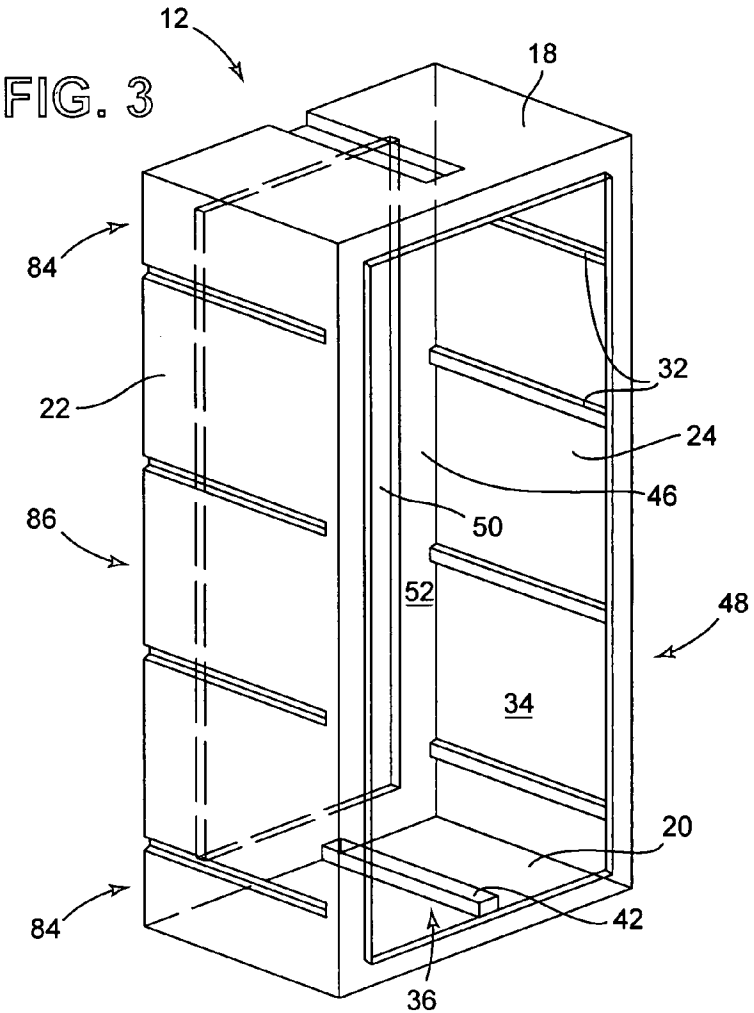
FIG. 3 is another front perspective view of the main cabinet of the storage system of FIG. 1.
Figure 2:
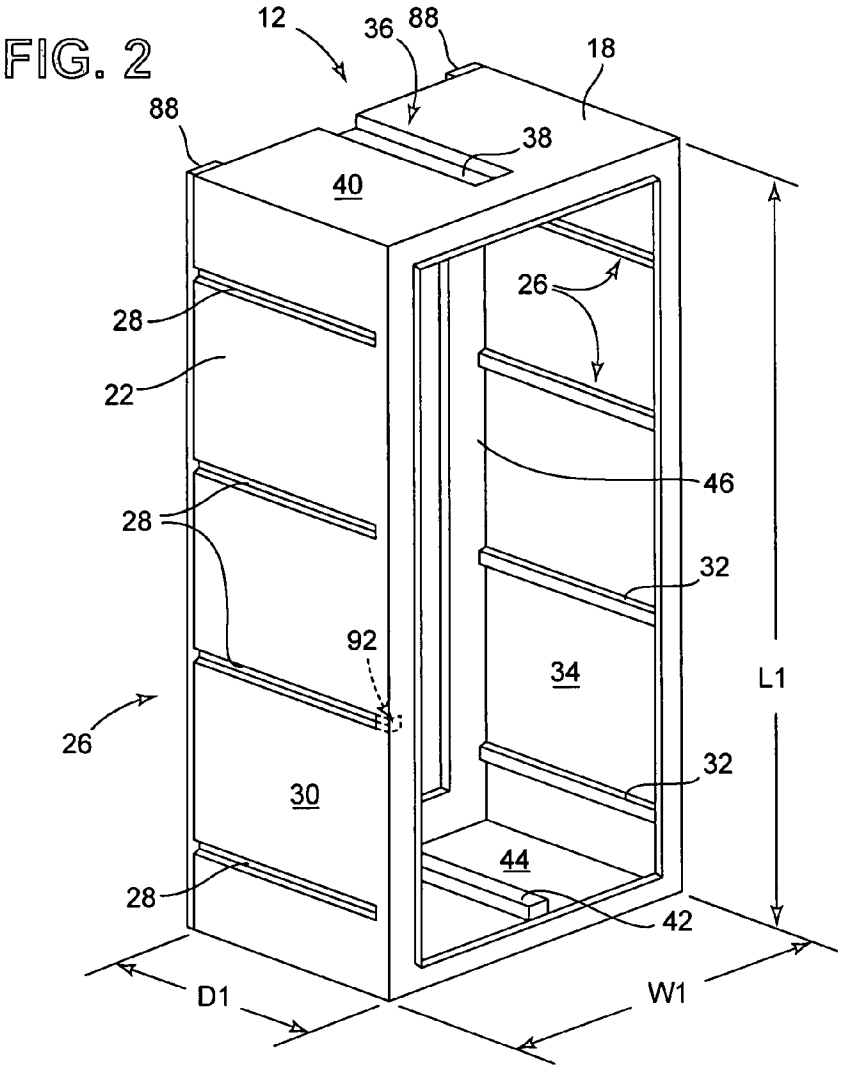
FIG. 2 is a front perspective view of a main cabinet of the storage system of FIG. 1, shown in a vertical orientation.
Figure 4:
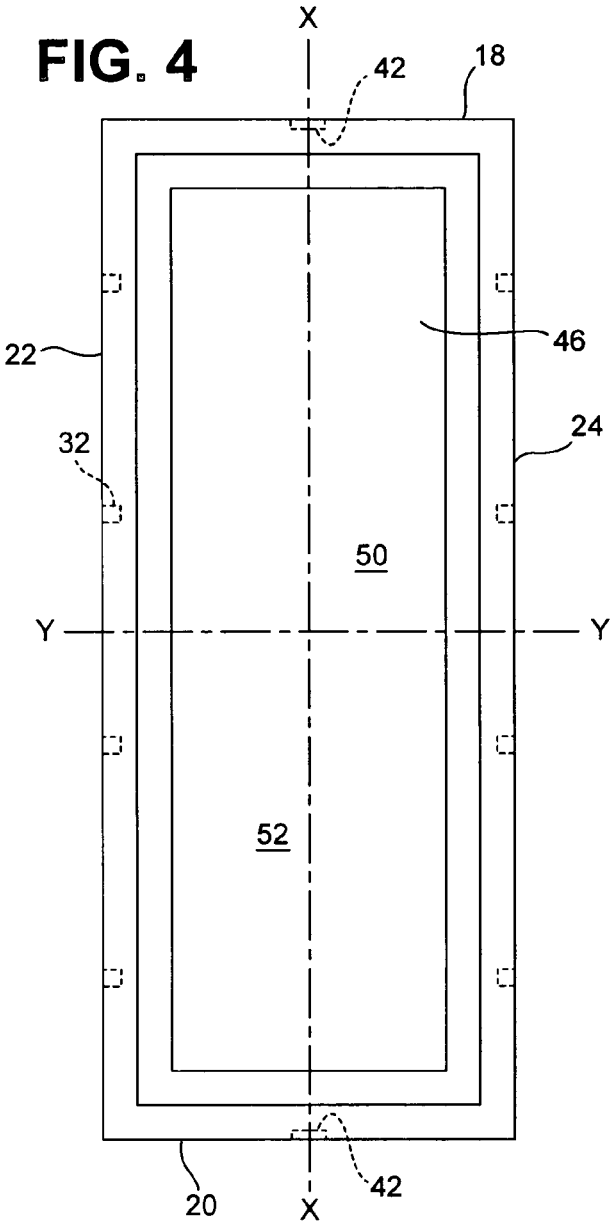
FIG. 4 is a front elevation view of the main cabinet of FIG. 2.
Figure 5:
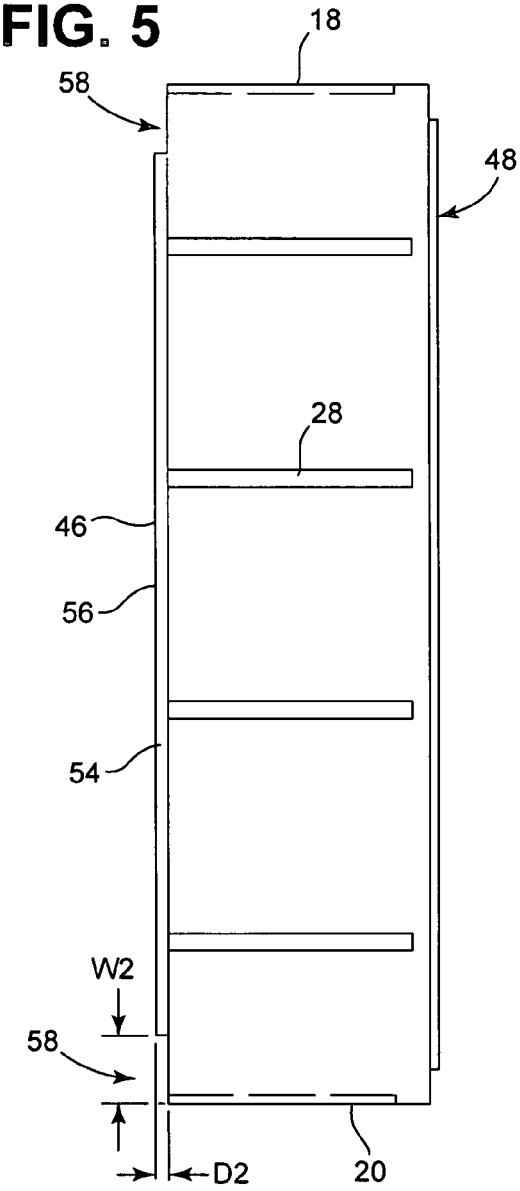
FIG. 5 is a side elevation view of the main cabinet of FIG. 2.
Figure 6:
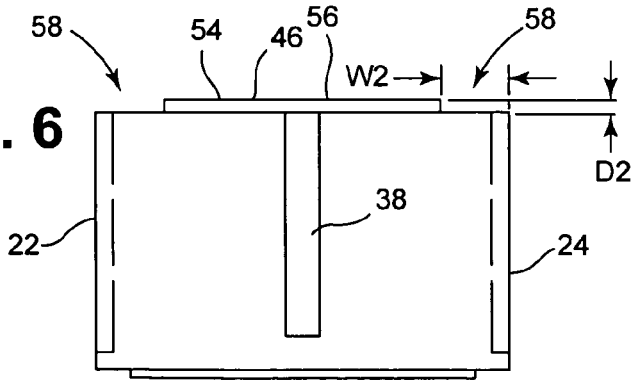
FIG. 6 is a top plan view of the main cabinet of FIG. 2.

Referring to FIGS. 2 and 3, the main cabinet 12 has a first pair of opposing walls 18, 20 and a second pair of opposing walls 22, 24. For purposes of clarity, the first pair of opposing walls 18, 20 will be referred to as shorter walls and the second pair of opposing walls 22, 24 will be referred to as longer walls; although the main cabinet could have a generally square construction such that all walls are approximately the same length. The main cabinet further includes a rear wall 46 opposite a front opening 48. The interior of the main cabinet can be enclosed by providing a door 62 (schematically represented in FIG. 1) that covers the front opening 48.

Each of the longer walls 22, 24 of the main cabinet has integral shelf supports 26. The integral shelf supports 26 include a groove 28 (e.g., notch or recess) formed in an exterior surface 30 of the walls 22, 24, and a corresponding projection 32 (e.g., rib or lip) integrally formed on an interior surface 34 of the walls. What is meant by "corresponding" is that the groove and the projection are the inverse of one another, or formed by the same structure; i.e., the same wall portion that forms the groove also forms the projection. In the illustrated embodiment, the shelf supports 26 of each longer wall 22, 24 include four grooves 28 and four corresponding projections 32.

Each of the shorter walls 18, 20 of the main cabinet 12 also has integral shelf supports 36. The integral shelf supports 36 similarly include a groove 38 and a corresponding projection 42 ("corresponding" as defined above). The groove 38 is formed in an exterior surface 40 of the walls 18, 20, and the projection 42 is integrally formed on an interior surface 44 of the walls. In the illustrated embodiment, the shelf supports 36 of each shorter wall 18, 20 include a single groove 38 and one corresponding projection 42. As will be described in greater detail hereinafter, the integral shelf supports 26, 36 of the longer and shorter walls are configured to support both the internal shelving 14 and the external shelving 16 of the system 10. The integral shelf supports further function as structural strength elements that strengthen the walls and the overall structure of cabinet.

Referring now to FIGS. 3-6, the rear wall 46 of the main cabinet 12 has a depression or recess 50 and a corresponding shoulder structure 54 (e.g., projection or ridge) ("corresponding" as defined above). The recess 50 is formed in an interior surface 52 of the rear wall 46 and the shoulder structure 54 is integrally formed on an exterior surface 56 of the rear wall. The shoulder structure 54 defines a notch or notched region 58 that extends around the entire perimeter of the rear wall 46 in the wall's exterior surface 56.

Figure 7:
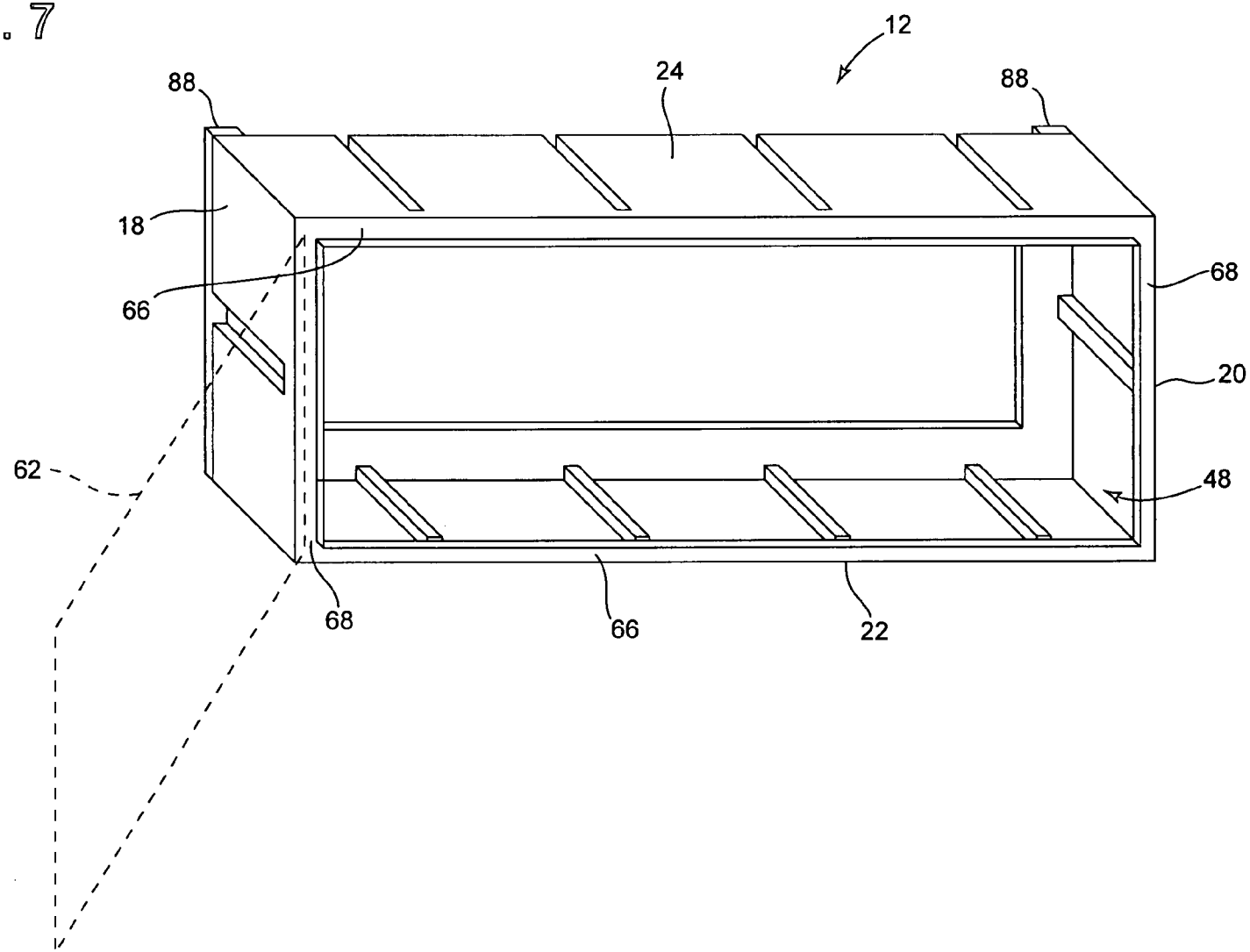
FIG. 7 is a front perspective view of the main cabinet of FIG. 2, shown in a horizontal orientation.

The main cabinet 12 is symmetrically designed along both a longitudinal axis X-X (FIG. 4) and a lateral axis Y-Y. Referring back to FIG. 1, the door 62 is fastened to one of two longitudinal sides 66 that define the front opening 48 of the main cabinet 12. Because of the symmetrical cabinet design, the door 62 can be fastened to either one of the longitudinal sides 66 to provide a rightward-opening door or a leftward-opening door when the main cabinet 12 is mounted in a vertical orientation. In the alternative, because of the symmetrical cabinet design, the main cabinet can be flipped or rotated 180 degrees so that the door can function as a rightward-opening door or a leftward-opening door when the door is fastened to only a particular one of the longitudinal sides 66. As can be understood, when the main cabinet is mounted in a horizontal orientation (see e.g., FIG. 7), a door mounted to a longitudinal side 66 can either open downward or open upward. Similarly, as illustrated in FIG. 7, the door 62 can be secure to one of two lateral sides 68 that define the front opening 48 of the main cabinet 12. The door can further include a handle for opening and closing the door, and a latch that locks the door to safeguard items stored inside the cabinet.

Referring again to FIG. 1, the notched region 58 (FIGS. 3-6) of the cabinet 12 defines a molded-in wall-mounting arrangement that permits a user to mount the main cabinet 12 directly on an existing wall 60. To mount the main cabinet 12 to the wall 60, support boards 64 are first affixed to the wall. In the illustrated embodiment, the notched region 58 has a notch depth D2 (FIGS. 5 and 6) of one inch and a notch width W2 of four inches; accordingly, standard 1"×4" boards are being used as support boards 64. The notched region 58 of the wall-mounting arrangement receives each support board 64 such that a majority of the rear wall 46 of the cabinet 12 is flush with the existing wall 60. As can be understood, the 1"×4" support board is an exemplary mounting board size and other sized mounting boards can be used and/or sized notch regions can be provided in accordance with the principles disclosed.

The molded-in mounting arrangement of the present cabinet 12 allows a user to mount the cabinet to a wall without the difficultly associated in placing or locating a large storage structure relative to hidden wall studs or wall supports. In particular, to mount the present cabinet 12 in a vertical orientation, one or two lengths of 1"×4" boards are secured to the wall studs of an existing wall. In the illustration of FIG. 1, upper and lower horizontal boards 64 are secured to an existing wall 60; however, in applications where lighter objects are being stored, only an upper board can be used.

Mounting a length of a board relative to a wall stud is far less difficult than placing, holding, and mounting a large cabinet structure relative to a wall stud. With the mounting boards (e.g., 64) secured to the wall, the cabinet 12 is then mounted to the boards by driving fasteners 70 (FIG. 1), such as anchor screws, through the rear wall 46 of the cabinet. Pre-formed holes may be provided in the rear wall 46 to receive the fasteners. With this mounting arrangement, the system 10 can be mounted at any location on an existing wall. That is, the boards 64 can be selectively positioned and mounted to the existing wall 60 at a desired vertical height, and the cabinet mounted to the boards 64 at any desired horizontal location along the boards. The vertical and horizontal placement of the cabinet 12 is thereby not constrained by the particular locations of wall studs.

Figure 8:
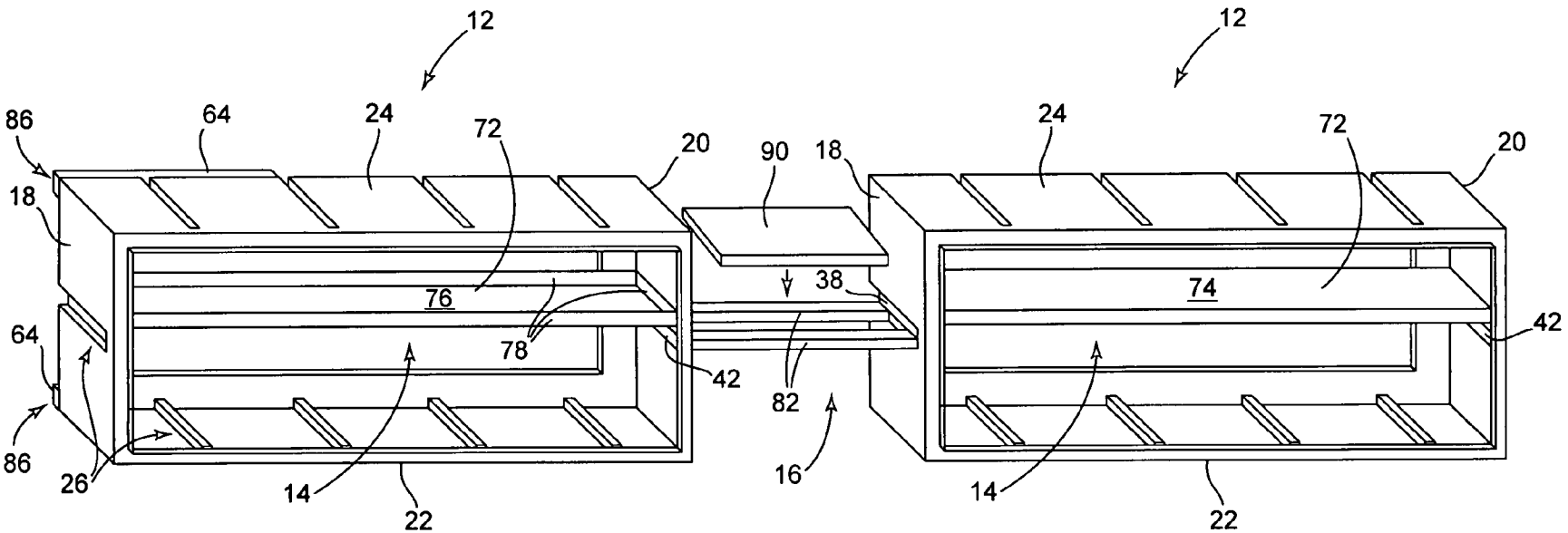
FIG. 8 is a front perspective view of another embodiment of a storage system, in accordance with the principles disclosed.

The storage system 10 of FIG. 1 includes two cabinets 12, vertically oriented and mounted to two horizontal boards 64. The horizontal boards 64 are received within shorter length portions 84 (FIG. 3) of the notched region 58 (i.e., the portions 84 of the notched region 58 that extend along the width W1 (FIG. 2) of the cabinet (see also FIG. 5)). As shown in FIG. 8, the cabinet 12 can also be horizontally mounted to horizontal boards 64 (only partly shown) by rotating the cabinets so that the horizontal boards 64 are received within longer length portions 86 (see also FIG. 3) of the notched region 58 (i.e., the portions 86 of the notched region 58 that extend along the length L1 of the cabinet).

In general, the present system 10 can be customized to accommodate a variety of storage needs. In one illustrative example, two horizontal boards, each 8 feet long, can be mounted to a wall. Four 2-foot wide W1 cabinets can be vertically mounted to the 8-foot boards in a locker-type arrangement; or two 2-foot wide cabinets can be vertically mounted at each end of the 8-foot board with 4-foot external shelves extending between the cabinets (see e.g., FIG. 1). Alternatively, two horizontal boards, each 15 feet long, can be mounted to a wall. Two 5-foot long cabinets can be horizontally mounted at each end of the 15-foot board with 4-foot external shelves extending between the cabinets (see e.g., FIG. 8). As can be understood, the mounting arrangement presently disclosed permits a user to mount the cabinets in a variety of groupings and spacing configurations, and orientations. In the above examples, the lower board also aids in holding or supporting the weight of the cabinets. In particular, the shoulder structure 54 of the rear wall 46 of each cabinet 12 rests upon the edge of the lower board so that the entire weight of the cabinet is not carried only by the fasteners 70.

In another illustrated example, four vertical boards can be spaced and mounted to accommodate two cabinets with 4-foot external shelves extending between the cabinets (see, for example, FIGS. 2 and 7 illustrating vertically mounted boards 88). If the vertical boards are 1"×4"×5' boards (FIG. 2), or 1"×4"×2' boards (FIG. 7), the boards 88 are generally hidden from view. If a locker-type arrangement of four cabinets is desired, 1"×8" vertical boards can be used to mount adjacent cabinets, each cabinet 12 receiving half of the 1"×8" board within the cabinet's notched region 58.

The molded-in mounting arrangement presently disclosed not only accommodates the different mounting orientations of the disclosed cabinet 12 but also allows a user to mount the cabinet to a variety of wall constructions. For instance, in a building having sheet rock or solid wall constructions, a user can anchor one or two boards at a desired height and secure the main cabinet at any location along the boards, as previously described. In other building applications, only a steel outside liner with a horizontal girt is provided, making it hard to hang anything. The present cabinet 12 can be mounted by installing two 1"×4" boards vertically, and securing the main cabinet to the vertical boards at any desired height along the board. Yet also, in a building with concrete walls, the cabinet 12 can be mounted to vertical or horizontal boards that are anchored to the concrete wall. The cabinet 12 can further be mounted to walls that are made of a solid construction, such as solid wood or concrete, without the use of the 1"×4"

boards. The mounting arrangement of the present cabinet and system is not limited to use with a particular wall construction but rather permits use of the cabinet and system with a variety of building structures.

Referring back to FIG. 1, the main cabinet 12 of the present system includes a unique shelving arrangement. For example, the integral shelf supports 26, 36 of the longer walls and the shorter walls support both the internal shelving 14 and the external shelving 16 of the present system 10.

In particular, the projections 32 formed on the interior surface 34 of the longer walls 22, 24 are arranged to support internal shelves 72. The internal shelving 14 is adjustable; that is the shelves 72 of the internal shelving 14 are selectively removable and positionable so that the inside of the main cabinet 12 can be customized to the user's particular need. In the illustrated embodiment of FIG. 1, a top shelf is provided and the remaining shelves are removed for storage of large items, such as golf clubs, for example. When the main cabinet 12 is mounted in a horizontal orientation (see FIG. 8), the projections 42 of the shorter walls 18, 20 support a horizontally-oriented internal shelf 72.

In the illustrated embodiment, the internal shelves 72 are molded. The molded shelves 72 define a flat or planar side 74, and an opposite tray side 76. The opposite tray side 76 has walls or sides 78 around the tray perimeter to aid in retaining items that could otherwise roll off the shelf. The planar side 74 has open sides. The internal shelves 72 are supported by the projections (e.g., 32, FIG. 1) in either a planar side up orientation or a tray side up orientation. The user can thereby customize the particular internal shelving style to meet the user's need, and later modify the internal shelving, without having to purchase additional or different type shelves.

The integral shelf supports 26 of the main cabinet 12 further provide additional shelving storage when two or more main cabinets 12 are located or mounted a distance apart from one another. As illustrate in FIG. 1, the projections 32 that support the internal shelving 14 also define the grooves 28 that support the external shelving 16 that spans between two cabinets.

The grooves 28 extend from the rear wall 46 toward the front opening 48 of cabinet 12. An external shelf 80 can be inserted in the groove 28 from the rear of the cabinet 12 toward the front of the cabinet. Accordingly, during installation, the external shelf 80 is inserted into the grooves 28 of the cabinets prior to securing the cabinets to the wall. Similar to the internal shelves 72, the external shelves 80 can be molded with a planar open side 74 and a tray side 76, and likewise be supported by the grooves 28 of the integral shelf supports 26 in either a planar side up orientation or a tray side up orientation.

In the alternative, the two cabinets can be first mounted to the wall. The ends of frame boards or steel supports 82 can then be diagonally inserted into two opposing grooves 28 and slid perpendicular to the walls of the cabinets. In FIG. 1, the frame boards 82 have been diagonally inserted and slid toward each end of the grooves 28. A wider shelf board (e.g., 90, FIG. 8) can be placed on top of the frame boards 82 to provide extra shelving space. In this alternative, the user can add or remove external shelving space as desired without removing or un-mounting the main cabinets 12 from the wall 60. In yet a different embodiment, the grooves 28, 38 can be constructed to extend to the longitudinal and lateral sides 66, 68 at the front of the cabinet (see, for example, extended groove portion 92 in FIG. 2) so that the shelves can be inserted from the front toward the rear. In this embodiment, external shelves can be added or removed from the front of a mounted cabinet.

In the illustrated embodiment of FIG. 1, the storage system can accommodate four horizontal external shelves that span the distance between the two cabinets. The lengths of external horizontal shelves (e.g., 80) depend upon to the distance between the two cabinets. In the illustrated embodiment of FIG. 8, a single external horizontal shelf can be positioned between the two horizontal cabinets; i.e., inserted into the grooves 38 of the shorter walls 18, 20 in both the methods described above.

The main cabinet 12, as well as the storage system 10 as a whole, can be customized for use in the home, garage, or business. One such business that can benefit from the present cabinet and system design is a golf course business. At golf courses, most club owners take their golf clubs home or take a chance that their clubs will be safe when not stored in a golf cart storage shed, for example. The present cabinet 12 and system 10 provide safe and convenient storage for golf clubs and accessories.

The above specification provides a complete description of the present invention. Since many embodiments of the invention can be made without departing from the spirit and scope of the invention, certain aspects of the invention reside in the claims hereinafter appended.

What is claimed is:

1. A storage system, comprising:

a) first and second main cabinets, each cabinet having a top wall, a bottom wall, and side walls, each cabinet having integral shelf supports, the shelf supports including grooves formed in exterior wall surfaces of the cabinet and corresponding projections formed on interior wall surfaces of the cabinet, the grooves and corresponding projections being formed in opposite sides of the same wall portion of the side walls, the grooves and corresponding projections extending in a rearward-forward direction, the grooves and corresponding projections being formed in a rear edge of the side walls and being offset from a front edge of the side walls;

b) internal shelving including at least one internal shelf located within one of the first and second main cabinets, the internal shelf being supported by the projections of the one cabinet; and c) external shelving including at least one external shelf spanning between the first and second main cabinets, a first end of the external shelf being located within one groove of the first main cabinet, a second end of the external shelf being located within one groove of the second main cabinet.

2. The storage system of claim 1, wherein each of the first and second main cabinets is symmetrically constructed about a longitudinal axis of the cabinet and about a lateral axis of the cabinet.

3. The storage system of claim 2, wherein the first and second main cabinets are mounted in a horizontal orientation such that the longitudinal axes of the cabinets are generally horizontal.

4. The storage system of claim 2, wherein the first and second main cabinets are mounted in a vertical orientation such that the longitudinal axes of the cabinets are generally vertical.

5. The storage system of claim 1, wherein each of the first and second main cabinets includes a molded-in mounting arrangement, the molded-in mounting arrangement including a notch extending around the perimeter of a rear wall of the cabinet.

6. The storage system of claim 5, wherein the notch is sized to receive support boards mounted to an existing wall.

7. The storage system of claim 6, wherein the notch has a width and a depth, the width being about 4 inches, the depth being about 1 inch.

8. The storage system of claim 6, further including two parallel, horizontally oriented boards, the boards being received within first and second longer portions of the notch.

9. The storage system of claim 6, further including two parallel, horizontally oriented boards, the boards being received within first and second shorter portions of the notch.

10. The storage system of claim 6, further including two parallel, vertically oriented boards, the boards being received within first and second longer portions of the notch.

11. A storage cabinet, comprising:

a) two pairs of opposing walls and a rear wall, the two pairs of opposing walls and the rear wall defining an interior and an exterior, the exterior defining a notch that extends around the entire perimeter of the rear wall;

b) integral shelf supports that supports internal shelving and external shelving, the integral shelving supports being formed in each wall of the two pairs of opposing walls; and c) an internal shelf, wherein the shelf supports support the internal shelf in a selected one of both a first orientation and a second orientation, in the first orientation, the internal shelf providing a planar shelf surface with open sides, in the second orientation, the internal shelf providing a tray with upstanding sides.

12. The cabinet of claim 11, wherein the walls and integral shelf supports are symmetrically constructed about a longitudinal axis of the cabinet and about a lateral axis of the cabinet.

13. The cabinet of claim 11, wherein the notch has a width and a depth, the width being about 4 inches, the depth being about 1 inch.

14. The cabinet of claim 11, wherein the integral shelf supports include at least one groove and one corresponding projection formed in each wall of the two pairs of opposing walls.

15. A method of assembling a storage system, the method comprising the steps of:

a) providing a cabinet having a rear wall, the rear wall defining a notch that extends around a perimeter of the rear wall;

b) mounting a board to an existing wall;

c) positioning the cabinet relative to the board such that the board is located within the notch formed in the rear wall; and d) securing the cabinet to the board;

e) wherein the cabinet can be mounted in a selected one of both a horizontal orientation and a vertical orientation, the notch extending around the perimeter of the rear wall receiving the cabinet in either orientation.

16. The method of claim 15, wherein the step of mounting the board to an existing wall includes mounting the board in a generally horizontal orientation.

17. The method of claim 15, wherein the step of mounting the board to an existing wall includes mounting the board in a generally vertical orientation.

18. A storage system, comprising:

a) first and second main cabinets, each cabinet having integral shelf supports, the shelf supports including grooves formed in exterior wall surfaces of the cabinet and corresponding projections formed on interior wall surfaces of the cabinet;

b) internal shelving including at least one internal shelf located within one of the first and second main cabinets, the internal shelf being supported by the projections of the one cabinet; and c) external shelving including at least one external shelf spanning between the first and second main cabinets, a first end of the external shelf being located within one groove of the first main cabinet, a second end of the external shelf being located within one groove of the second main cabinet;

d) wherein each of the first and second main cabinets is symmetrically constructed about a longitudinal axis of the cabinet and about a lateral axis of the cabinet.

19. The storage system of claim 18, wherein the first and second main cabinets are mounted in a horizontal orientation such that the longitudinal axes of the cabinets are generally horizontal.

20. The storage system of claim 18, wherein the first and second main cabinets are mounted in a vertical orientation such that the longitudinal axes of the cabinets are generally vertical.

21. The storage system of claim 18, wherein each of the first and second main cabinets includes a molded-in mounting arrangement, the molded-in mounting arrangement including a notch extending around the perimeter of a rear wall of the cabinet.

22. The storage system of claim 21, wherein the notch is sized to receive support boards mounted to an existing wall.

23. The storage system of claim 22, wherein the notch has a width and a depth, the width being about 4 inches, the depth being about 1 inch.

24. The storage system of claim 22, further including two parallel, horizontally oriented boards, the boards being received within first and second longer portions of the notch.

25. The storage system of claim 22, further including two parallel, horizontally oriented boards, the boards being received within first and second shorter portions of the notch.

26. The storage system of claim 22, further including two parallel, vertically oriented boards, the boards being received within first and second longer portions of the notch.

27. A storage system, comprising:

a) first and second main cabinets, each cabinet having integral shelf supports, the shelf supports including grooves formed in exterior wall surfaces of the cabinet and corresponding projections formed on interior wall surfaces of the cabinet;

b) internal shelving including at least one internal shelf located within one of the first and second main cabinets, the internal shelf being supported by the projections of the one cabinet; and c) external shelving including at least one external shelf spanning between the first and second main cabinets, a first end of the external shelf being located within one groove of the first main cabinet, a second end of the external shelf being located within one groove of the second main cabinet;

d) wherein each of the first and second main cabinets includes a molded-in mounting arrangement, the molded-in mounting arrangement including a notch extending around the perimeter of a rear wall of the cabinet.

* * * * *